US010553419B2

(12) United States Patent
Shimozato et al.

(10) Patent No.: US 10,553,419 B2
(45) Date of Patent: Feb. 4, 2020

(54) ELECTRODE BODY AND HIGH-PRESSURE DISCHARGE LAMP

(71) Applicant: USHIO DENKI KABUSHIKI KAISHA, Tokyo (JP)

(72) Inventors: Masahiro Shimozato, Tokyo (JP); Tetsuya Kitagawa, Tokyo (JP)

(73) Assignee: USHIO DENKI KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/472,353

(22) PCT Filed: Dec. 7, 2017

(86) PCT No.: PCT/JP2017/043921
§ 371 (c)(1),
(2) Date: Jun. 21, 2019

(87) PCT Pub. No.: WO2018/116839
PCT Pub. Date: Jun. 28, 2018

(65) Prior Publication Data

US 2019/0362959 A1 Nov. 28, 2019

(30) Foreign Application Priority Data

Dec. 22, 2016 (JP) ..... 2016-248605

(51) Int. Cl.
*H01J 61/073* (2006.01)
*H01J 61/36* (2006.01)

(52) U.S. Cl.
CPC ..... *H01J 61/0732* (2013.01); *H01J 61/0735* (2013.01); *H01J 61/36* (2013.01)

(58) Field of Classification Search
CPC ..... H01J 61/06–0737; H01J 1/14–28; H01J 9/02–06; B23K 35/00–007
See application file for complete search history.

(56) References Cited

U.S. PATENT DOCUMENTS 4,039,883 A * 8/1977 Damsteeg ..... B23K 35/001 313/633
2007/0228982 A1* 10/2007 Morimoto ..... H01J 61/0735 313/633

(Continued)

FOREIGN PATENT DOCUMENTS

JP S48-11984 Y2 3/1973
JP S60-79659 A 5/1985

(Continued)

OTHER PUBLICATIONS

An Office Action; "Notice of Reasons for Refusal," issued by the Japanese Patent Office, which corresponds to Japanese Patent Application No. JP2016-248605; with English language translation.

(Continued)

*Primary Examiner* — Mariceli Santiago
(74) *Attorney, Agent, or Firm* — Studebaker & Brackett PC

(57) ABSTRACT

An electrode module includes an electrode and a core wire inserted into a core wire insertion hole of the electrode. When inserting the core wire into the core wire insertion hole of the electrode, the core wire can be inserted smoothly, thereby avoiding occurrence of chipping or cracking in the core wire insertion hole. A low-friction layer is provided on the inner surface of the core wire insertion hole of the electrode and/or the outer periphery of the inserted portion of the core wire.

10 Claims, 3 Drawing Sheets

(56) References Cited

U.S. PATENT DOCUMENTS

| | | | | |
|---|---|---|---|---|
| 2010/0244689 | A1* | 9/2010 | Kagebayashi ..... | H01J 61/0732<br>313/632 |
| 2014/0320002 | A1* | 10/2014 | Watanabe ..... | H01J 61/86<br>313/632 |

FOREIGN PATENT DOCUMENTS

| | | | |
|---|---|---|---|
| JP | 2004-111235 | A | 4/2004 |
| JP | 2007-311300 | A | 11/2007 |
| JP | 2010-282758 | A | 12/2010 |
| JP | 2011-187256 | A | 9/2011 |

OTHER PUBLICATIONS

International Search Report issued in PCT/JP2017/043921; dated Feb. 20, 2018.
Written Opinion issued in PCT/JP2017/043921; dated Feb. 20, 2018.

* cited by examiner

ELECTRODE BODY AND HIGH-PRESSURE DISCHARGE LAMP

TECHNICAL FIELD

The present invention relates to an electrode body or module for use in a high-pressure discharge lamp, and a high-pressure discharge lamp using such electrode module(s). In particular, the present invention relates to the electrode module for use in a high-pressure discharge lamp used as a light source in an exposure process, which is for example employed to manufacture a semiconductor and a liquid crystal, a light source for a projector, which is employed for projection, or a light source in an analyzing device.

BACKGROUND ART

The high-pressure discharge lamp includes a light-emitting tube and a pair of electrodes that face each other in the light-emitting tube, a distance between free ends of the two electrodes is short, and the high-pressure discharge lamp is similar to a point light source. Thus, the high-pressure discharge lamp is used together with an optical system, and serves as the light source of an exposure device or a projector.

One example of such high-pressure discharge lamp is disclosed in Japanese Patent Application Laid-Open Publication No. Sho 60-79659 (Patent Literature Document 1).

FIG. 9 shows the high-pressure discharge lamp of this prior art. A light-emitting tube 10 of the high-pressure discharge lamp has a light-emitting portion 11, which is formed in a generally spherical shape and positioned in the center, and sealing portions 12 formed at the opposite ends of the light-emitting portion 11. In the light-emitting portion 11, a cathode 21 and an anode 31, both of which may be made from tungsten or the like, are arranged such that they face each other. A light-emitting substance such as mercury or xenon is sealedly present in a light-emitting space of the light-emitting portion 11.

Core wires 22 and 23 coupled to the cathode 21 and the anode 31 respectively, are sealed in the sealing portions 12 and 12 with a metal foil (not shown) or a structure (not shown) that is made from materials having slightly different coefficients of thermal expansion and connecting between the light-emitting tube and the core wire.

When the lamp is emitting light, an electric current flows between the two electrodes, and the temperature of the electrodes becomes extremely high due to the radiation from plasma and the resistance heating. In particular, the temperature of the anode becomes very high, namely, 2,000 degrees C. or more. Thus, it is necessary for the anode to be made from a metal having a small vapor pressure at a high temperature and to have a large thermal capacity in order to suppress the temperature increase of the anode. For example, as shown in FIG. 9B, the anode to be employed is entirely made from tungsten.

An electrode module 30 is constructed by making a core wire insertion hole 33 at the rear end of the electrode 31, inserting the core wire 32 into the insertion hole 33, and fixing it therein. Thus, the difference between the inner diameter of the core wire insertion hole of the electrode and the outer diameter of the core wire is designed to be extremely small in order to prevent the core wire from falling out.

As such, the insertion of the core wire may be difficult or the core wire may not be inserted to a desired depth due to the manufacturing tolerance of the core wire and the core wire insertion hole, particularly, the manufacturing tolerance of the core wire insertion hole, and due to the offset between the center position of the core wire and the center position of the core wire insertion hole during the core wire inserting process. Also, if a larger force is applied for the press-fitting during the inserting process, an excessive stress may act on the end of the core wire insertion hole and it would cause defects, such as chipping and cracking.

LISTING OF REFERENCES

Patent Literature Documents

Patent Literature Document 1: Japanese Patent Application Laid-Open Publication No. Sho 60-79659

SUMMARY OF THE INVENTION

Problems to be Solved by the Invention

In view of the above-described problems of the conventional technologies, an object to be achieved by the present invention is to provide an electrode module and a high-pressure discharge lamp using the same, the electrode module including an electrode and a core wire inserted into a core wire insertion hole of the electrode and being configured such that when inserting the core wire into the core wire insertion hole of the electrode, the core wire can be inserted smoothly, thereby avoiding occurrence of chipping or cracking in the core wire insertion hole.

Solution to the Problems

In order to achieve the above-mentioned object, the electrode module of the present invention is characterized in that a low-friction layer is provided on the inner surface of the core wire insertion hole of the electrode and/or the outer periphery of the inserted portion of the core wire.

The low-friction layer may be a carbonized layer.

The low-friction layer may be a nitrided layer.

The coefficient of friction of the low-friction layer may be 0.2 to 0.35 when evaluated by a ball-on-disk friction test.

The low-friction layer may be intermittently provided on the inner surface of the core wire insertion hole of the electrode and/or the outer periphery of the inserted portion of the core wire.

The low-friction layer may be provided on the outer periphery of the core wire such that the low-friction layer may extend in a greater area than the inserted portion of the core wire.

The front end portion of the core wire may be chamfered.

A space may be left between a front end of the core wire and a bottom of the core wire insertion hole.

A metal foil may be placed in a gap between the core wire and the core wire insertion hole of the electrode.

The present invention also provides a high-pressure discharge lamp that has sealing portions at opposite ends of a light-emitting portion, characterized in that a low-friction layer is provided on an inner surface of a core wire insertion hole of an electrode and/or an outer periphery of an inserted portion of the core wire.

Advantageous Effects of the Invention

In the electrode module of the present invention, and the high-pressure discharge lamp using the electrode module, the low-friction layer is provided on the inner surface of the core wire insertion hole of the electrode and/or the outer periphery of the inserted portion of the core wire. Therefore, the insertion of the core wire proceeds very smoothly and the work efficiency improves. Also, the chipping and cracking of the wire core insertion hole do not occur.

DESCRIPTION OF EMBODIMENTS

Figure 1A:
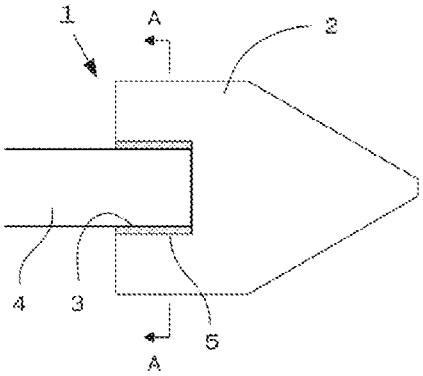
FIGS. 1A and 1B are a set of cross-sectional views of an electrode module according to a first embodiment of the present invention.
Figure 1B:
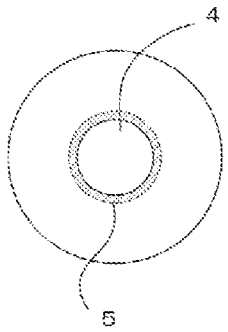

FIGS. 1A and 1B are a set of cross-sectional views of a first embodiment. Specifically, FIG. 1A is a lateral cross-sectional view, and FIG. 1B is a cross-sectional view taken along the line A-A in FIG. 1A.

In FIGS. 1A and 1B, an electrode body or module 1 includes an electrode 2, and a core wire 4 inserted in a core wire insertion hole 3 formed in a rear end of the electrode 2. A low-friction layer 5 is formed on an inner surface of the core wire insertion hole 3. The low-friction layer 5 is made from a carbonized compound such as tungsten carbide, a nitride compound such as tungsten nitride, or the like.

One exemplary method of making the low-friction layer 5 on the inner surface of the core wire insertion hole 3 is as follows. In this example, the carbonized layer is formed as the low-friction layer 5. A tungsten carbide, which is a carbonized compound of tungsten, is used.

An organic binder such as nitrocellulose (cellulose nitrate) is melted in butyl acetate to prepare a mixed solution, and a carbon powder is added to this mixed solution to prepare a solution that contains carbon. Alternatively, an India ink (black ink) may be used.

This solution is applied on the inner surface of the core wire insertion hole by a writing brush or a paintbrush, or by spraying. Alternatively, the solution may be loaded into the core wire insertion hole, and an unnecessary portion of the solution may be removed later, in order to apply the solution in a desired manner.

After the applied solution is dried, the electrode is heated to a temperature between 1,500 and 1,800 degrees C. in a vacuum high-temperature furnace, and the temperature is maintained for approximately 30 minutes for sintering. Thus, the low-friction layer 5 is formed on the inner surface of the core wire insertion hole 3.

The coefficient of friction of the low-friction layer, which is made from a metal carbide with the above-described method, is between 0.2 and 0.35 if evaluated by a ball-on-disk friction test. When this is compared to a fact that the coefficient of friction of a tungsten metal, which does not contain a carbide layer (low-friction layer), is approximately 0.5, the coefficient of friction of the low-friction layer is reduced to approximately a half or less.

If the low-friction material of the low-friction layer 5 is a nitride layer, and tungsten nitride, which is a nitride compound of tungsten, is used, the electrode is placed and heated in an atmosphere that contains ammonia or nitrogen. This causes nitrogen to penetrate into the surface, thereby making a compound. During this process, those portions which should not be nitrided, i.e., portions other than the core wire insertion hole 3, may be masked, and only the inner surface of the core wire insertion hole 3 may have the low-friction layer 5 made from tungsten nitride such as WN or $WN_2$.

Figure 2:
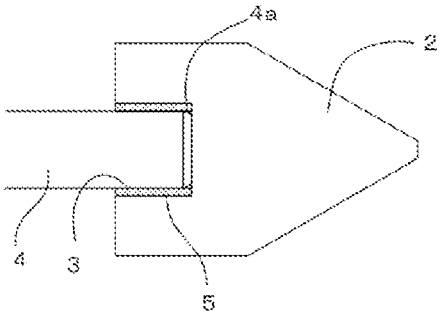
FIG. 2 is a cross-sectional view according to a second embodiment.

FIG. 2 shows a second embodiment, and the front end 4*a* of the core wire 4 is chamfered such that the insertion into the core wire insertion hole 3 of the electrode 2 becomes smoother.

Figure 3:
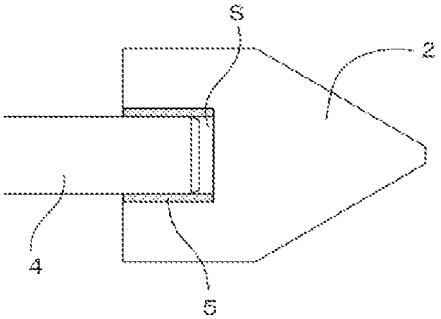
FIG. 3 is a cross-sectional view according to a third embodiment.

Alternatively, as shown in FIG. 3, the core wire 4 may not be received by the entirety of the core wire insertion hole 3, i.e., the core wire 4 may not reach the bottom of the core wire insertion hole. In other words, the space S may be left at the front of the core wire 4 when the core wire is inserted into the core wire insertion hole. In this case, the low-friction layer 5 on the inner surface of the core wire insertion hole 3 may be formed in only that area which receives the core wire 4, or may be formed on the entire inner surface of the core wire insertion hole 3 while considering the easiness of the work of forming the low-friction layer.

In each of the above-described embodiments, the low-friction layer 5 is continuously formed in the circumferential direction of the inner surface of the core wire insertion hole 3. In contrast, a fourth embodiment shown in FIG. 4 has the low-friction layer formed intermittently in the circumferential direction of the inner surface of the core wire insertion hole.

Figure 5A:
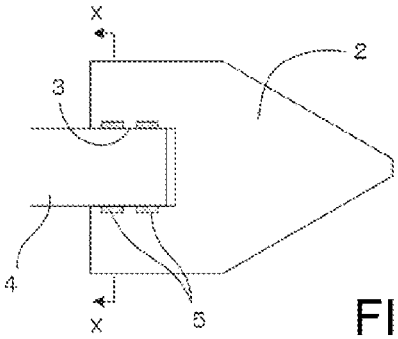
FIG. 5A is a cross-sectional view according to a fifth embodiment.
Figure 5B:
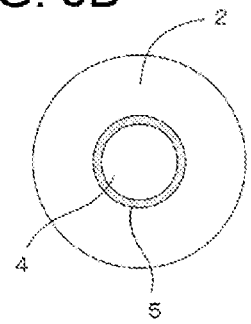
FIG. 5B is a cross-sectional view taken along the line X-X in FIG. 5A.

Alternatively, in a fifth embodiment shown in FIG. 5, the low-friction layer 5 may be intermittently formed in the axial direction of the core wire insertion hole 3. The low-friction layer is formed on the inner surface of the core wire insertion hole.

Figure 6:
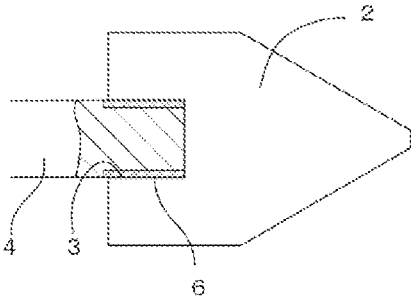
FIG. 6 is a cross-sectional view according to a sixth embodiment.

Although the low-friction layer 5 is formed on the inner surface of the core wire insertion hole 3 in each of the first embodiment to the fifth embodiment, a low-friction layer 6 is formed on the core wire 4 in a sixth embodiment shown in FIG. 6. The low-friction layer 6 is formed over the outer surface of the front end portion of the core wire 4, i.e., the portion which is received in the core wire insertion hole. It should be noted that the area where the low-friction layer 6 is formed does not have to exactly match the received portion of the core wire 4, i.e., as shown in FIG. 6, the area where the low-friction layer 6 is formed may slightly be greater than the received portion of the core wire.

The method of forming the low-friction layer 6 on the core wire 4 may be similar to the method described in the first embodiment. Specifically, the solution that contains carbon may be applied on the front end portion of the core wire 4 by the writing brush or the paintbrush, or by spraying. Alternatively, the front end portion of the core wire 4 is immersed into the solution and pulled up in order to apply the solution on the front end portion of the core wire. The solution is then dried and heated to form the low-friction layer.

Figure 4:
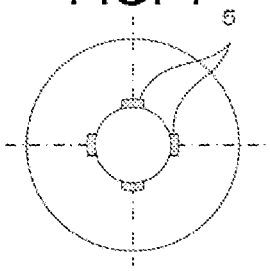
FIG. 4 is a cross-sectional view according to a fourth embodiment.

It should be noted that when the low-friction layer 6 is formed on the outer surface of the wire core 4 in the portion received in the wire core insertion hole as shown in FIG. 6, the low-friction layer 6 may be formed intermittently in the circumferential direction of the core wire or in the axial direction of the core wire, as shown in FIG. 4 and FIG. 5.

Figure 7:
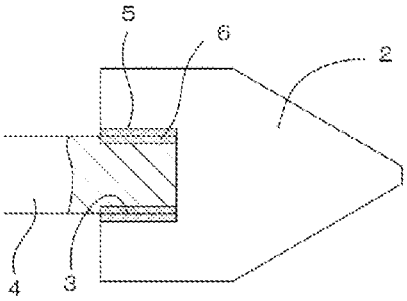
FIG. 7 is across-sectional view according to a seventh embodiment.

Alternatively, the low-friction layers 5 and 6 may be formed in the core wire insertion hole 3 and on the core wire 4, respectively. This example is shown in FIG. 7, as a seventh embodiment.

Specifically, the low-friction layer 5 is formed on the inner surface of the core wire insertion hole 3 of the electrode 2, and the low-friction layer 6 is formed on the outer surface of the front end portion of the core wire 4. The low-friction layer 6 is formed on the portion received in the core wire insertion hole.

Figure 8:
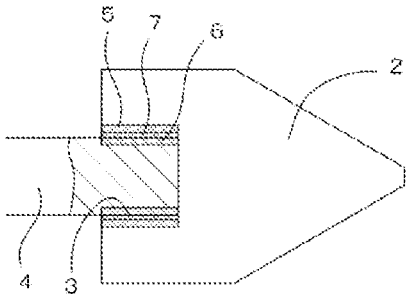
FIG. 8 is across-sectional view according to a second embodiment.
Figure 9A:
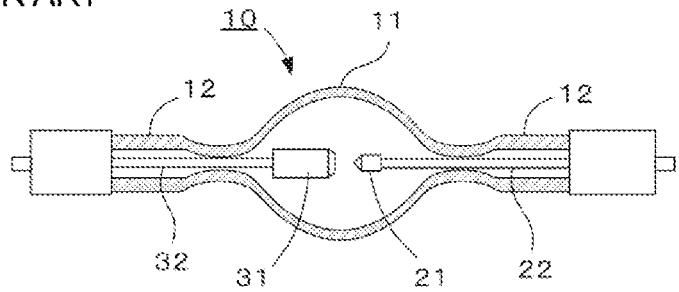
FIG. 9A PRIOR ART
FIG. 9A is a general view of a high-pressure discharge lamp.
Figure 9B:
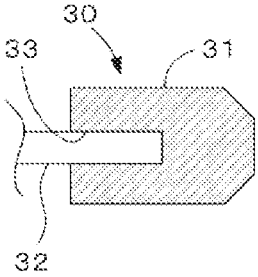
FIG. 9B PRIOR ART
FIG. 9B is a cross-sectional view of a conventional electrode module.

FIG. 8 illustrates an eighth embodiment. A metal foil 7 is placed in a gap between the core wire 4 and the core wire insertion hole 3. The metal foil 7 is wound around the front end portion of the core wire 4, and the core wire 4 is press-fitted into the core wire insertion hole 3. The metal foil 7 is made from a metal having a high-melting point such as Mo or Ta. The thickness of the metal foil 7 is, for example, approximately 0.15 mm With such configuration, no gap is present between the core wire 4 and the core wire insertion hole 3, and secure fixing is achieved.

The electrode module having the above-described structure may be used as each or one of the anode and the cathode in the high-pressure discharge lamp that has the sealing portions at opposite ends of the light-emitting portion.

As described above, the embodiments of the present invention are directed to the electrode module that includes the electrode, and the core wire received in the core wire insertion hole of the electrode, and the high-pressure discharge lamp using such electrode module(s). Because the low-friction layer is provided on the inner surface of the core wire insertion hole of the electrode and/or an outer periphery of that portion of the core wire which is received in the core wire insertion hole, the work of inserting the core wire into the core wire insertion hole of the electrode proceeds smoothly, and an unnecessary or excessive stress does not act on the electrode. Therefore, it is possible to prevent accidents such as breakage or the like.

REFERENCE NUMERALS AND SYMBOLS

1: Electrode module
2: Electrode
3: Core wire insertion hole
4: Core wire
4*a*: Chamfered portion at the front end
5, 6: Low friction layer
7: Metallic foil
S: Space

The invention claimed is:

1. An electrode module comprising an electrode, and a core wire inserted into a core wire insertion hole of the electrode, and further comprising a low-friction layer provided on an inner surface of the core wire insertion hole of the electrode and/or an outer periphery of an inserted portion of the core wire.

2. The electrode module according to claim 1, wherein the low-friction layer is a carbonized layer.

3. The electrode module according to claim 1, wherein the low-friction layer is a nitrided layer.

4. The electrode module according to claim 1, wherein a coefficient of friction of the low-friction layer is 0.2 to 0.35 when evaluated by a ball-on-disk friction test.

5. The electrode module according to claim 1, wherein the low-friction layer is intermittently provided on the inner surface of the core wire insertion hole of the electrode and/or the outer periphery of the inserted portion of the core wire.

6. The electrode module according to claim 1, wherein the low-friction layer is provided on the outer periphery of the core wire such that the low-friction layer extends in a greater area than the received portion of the core wire.

7. The electrode module according to claim 1, wherein a front end portion of the core wire is chamfered.

8. The electrode module according to claim 1, wherein a space is left between a front end of the core wire and a bottom of the core wire insertion hole.

9. The electrode module according to claim 1, wherein a metal foil is placed in a gap between the core wire and the core wire insertion hole of the electrode.

10. A high-voltage discharge lamp comprising sealing portions at opposite ends of a light-emitting portion, and at least one electrode module according to claim 1.

* * * * *